US005791440A

United States Patent [19]

Lonzinski et al.

[11] Patent Number: 5,791,440

[45] Date of Patent: Aug. 11, 1998

[54] SPEED LIMITING METHOD AND APPARATUS FOR LIFT TRUCK

[75] Inventors: Richard J. Lonzinski, Johnson City; Augustus R. Baldini, Binghamton, both of N.Y.

[73] Assignee: The Raymond Corporation, Greene, N.Y.

[21] Appl. No.: 695,684

[22] Filed: May 13, 1996

[51] Int. Cl.[6] ..... B66F 9/20

[52] U.S. Cl. ..... 187/223; 187/224

[58] Field of Search ..... 187/223, 224, 187/222; 414/630, 631

[56] References Cited

U.S. PATENT DOCUMENTS 4,265,337 5/1981 Dammeyer ..... 187/224

*Primary Examiner*—Kenneth Noland

*Attorney, Agent, or Firm*—Quarles & Brady

[57] ABSTRACT

A method and/or apparatus for reducing the maximum speed of a lift truck when a fork carriage exceeds a fork carriage trip height and a limit switch positioned at the trip height to detect trip height has failed. Using lift truck control signals, a calculated fork carriage height is determined and compared to the trip height which corresponds to the limit switch position. When the calculated height reaches the trip height and the limit switch does not provide a sensed signal, a latch is set in a non-volatile memory which limits the maximum truck speed until the limit switch is again operable.

20 Claims, 3 Drawing Sheets

POWER ON
52
MONITOR SENSED SIGNAL
54
LATCH SET ?
56
YES
NO
RESET PROTOCOL COMPLETE ?
58
NO
YES
CLEAR LATCH
60
SENSED SIGNAL INDICATES HIGH LIFT ?
62
YES
NO
CALCULATE LIFT HEIGHT
64
CALCULATED HEIGHT ≥ STORED TRIP HEIGHT ?
66
YES
NO
SET LATCH
72
FULL SPEED
68
SPEED LIMIT
74

SPEED LIMITING METHOD AND APPARATUS FOR LIFT TRUCK

FIELD OF THE INVENTION

The present invention relates to lift truck control systems and more particularly to a lift truck system having a fork carriage height checking mechanism that limits truck speed when a fork carriage height sensor malfunctions.

DESCRIPTION OF THE ART

Lift truck operator compensation is often tied to productivity which is primarily measured in both time (i.e. speed) and results (i.e. product moved). Such productivity based compensation schemes are designed to reduce costs by encouraging efficient use of equipment.

While increased productivity is important, physical limitations of equipment, and the environment in which equipment is used, necessarily limit techniques that can be safely used to increase productivity. This is particularly true in the lift truck industry where an operator can easily situate truck components in semi-stable configurations. For example, an operator may use a lift truck to move items between two remote locations where one or both locations are elevated (e.g. 20+ feet). Often, moved items are extremely heavy so that, when elevated on a fork carriage, the combined center of gravity for the truck and item is high.

Under these conditions a truck may be stable at low speeds. However, at increased speeds, a truck carrying an elevated item is only semi-stable at best, especially when turning a corner. When a load is elevated and a truck is turned at high speed, the truck may tip causing truck damage or injuring an operator or another person in the vicinity. Unfortunately, to increase productivity, truck operators often feel the need to operate trucks at high speeds regardless of fork carriage height.

Therefore, a need exists in lift truck control systems to limit the speed of a truck having an elevated fork carriage. Various systems exist to accomplish this. One common type of system employs limit switches, proximity sensors or the like, to establish a control signal when the fork carriage has been elevated to a trip height (i.e., the sensor height). When the trip height is exceeded, this system limits maximum truck speed. When the fork carriage is lowered below the trip height, the system increases the maximum speed.

While this type of system works well when the height sensors are operational, many operators seeking to increase productivity have found ways to disable the height sensors. Where a height sensor is disabled, the system will not limit truck speed even after the predetermined height has been reached and exceeded. Recognizing this problem, many system designers have developed a mechanism to periodically check height sensors to determine if the sensors are functional or if they have been tampered with or defeated.

One such method of checking height sensors requires that, upon truck start-up, truck speed is limited to a low value until the operator has raised (or lowered) the fork carriage sufficiently to trip the sensor(s), with subsequent full speed operation allowed only after the fork carriage is lowered below the sensor trip height.

This start-up testing protocol is required solely to check height sensor(s) operation and serves no useful truck operating purpose. Most operators consider this start-up protocol and other start-up protocol variations a major annoyance, as they limit productivity by requiring that a non-productive sequence of operations take place prior to the full truck capabilities being made available. In addition, this start-up protocol is typically done only once, each time the lift truck is turned on, rather than continuously throughout operation. Thus, in many cases the safety sensor is tested only once per day.

Moreover, the safety sensors are typically subject to defeat by tampering. After a start-up testing protocol is completed, a knowledgeable operator can disable the sensor and its intended limiting function. Then, at the end of a day, the operator can again enable the sensor so that, when checked again at start-up, the sensor indicates proper operation.

Thus, it would be advantageous to have a system that could determine if height sensors on a fork carriage are operational throughout the course of truck operation. Where a sensor fails for any reason, the system should limit truck speed until the sensors are again deemed operational.

SUMMARY OF THE INVENTION

The present invention includes an improved method and apparatus for verifying that a height sensor is functional and has not been defeated. Whenever the operator changes the height of the fork carriage, an on board processor computes a calculated fork carriage height. The calculated fork carriage height is compared to a stored switch trip height (i.e. a height corresponding to the actual trip height of a height switch). When the calculated height reaches the stored trip height, the processor identifies the fork carriage height condition and produces a limit signal.

When either the height switch produces a sensed signal, or the processor produces a limit signal, indicating that the calculated height has reached the stored trip height, maximum truck speed is limited. A resolver receives both limit and sensed signals. Normally, the resolver will receive both a limit signal and a corresponding sensed signal. In this case, the resolver recognizes that the height switch is operating properly and full speed capability will be restored when a subsequent switch signal indicates that the fork carriage has been lowered below the trip height.

If, however, the resolver receives a limit signal indicating that the calculated height has reached or exceeded the stored trip height and no switch signal has been received, the resolver recognizes that the switch has malfunctioned and that the truck requires service to correct the malfunction. In this case, truck speed is preferably limited until the resolver determines that the height switch is again working properly.

One object of the invention is to provide a switch checking redundancy mechanism whereby a control system can determine if a limit switch has malfunctioned for any reason (eg. break down or tampering). By calculating a fork carriage height and comparing the calculated height to a stored sensor height at which the switch should be activated, the system can determine when the switch is inoperable.

Another object is to eliminate the useless start-up switch testing protocol. Upon start-up, instead of initially driving the fork carriage to the trip height to check switch integrity, the present system allows normal truck operation until the stored trip height is reached in the course of normal operation at which point switch integrity is determined.

Yet another object is to provide a system that can identify intermittent switch malfunctions. The calculated fork carriage height indicates each time the fork carriage reaches the stored trip height meaning that a sensed signal should be received. Thus, every time the stored trip height is reached switch integrity is verified.

Preferably, after a switch malfunctions, the system must identify a valid transition of the switch signal in both directions (low to high and high to low, high and low corresponding to actual fork carriage positions) prior to again allowing full speed truck operation.

Another object is to cause an obvious change in truck operation that renders the truck effectively inoperable for its intended purpose. By "latching" a permanent speed reduction until a truck is serviced, the truck is rendered effectively less operable, due to reduced speed, for its intended purpose.

A further object is to prevent an operator from incrementally raising the mast to higher and higher heights with full speed operation until a height just below the trip height is reached. It has been recognized that after a switch malfunctions and truck speed is limited, an operator could reset the system by turning the truck off and restarting the truck despite switch failure. Then, the operator could again move at full speed until the calculated height again reaches the predetermined height at which point maximum speed would again be limited. This type of truck operation not only reduces productivity but also unnecessarily encumbers truck starting components. Latching prevents resetting of the system and forces immediate servicing.

One other object is to allow normal operation of a truck when a sensor is again working properly, despite an earlier identified sensor failure. Where a switch has been purposefully defeated by an operator and the system latches a reduced maximum speed, the operator can "fix" the switch by any effective means and, when the fork carriage is raised above the predetermined height and then again lowered so that the switch provides two correct sensed signals, the truck will again be fully operable. Thus, with the present invention, although switch failure will latch a reduced maximum speed, by fixing the switch, normal operation can be restored without requiring special maintenance procedures.

Yet another object is to provide both sensed and calculated fork carriage heights to facilitate truly accurate fork carriage height sensing. The calculated fork carriage height mechanism cannot be defeated and therefore, it may appear to be advantageous to simply provide the calculated height mechanism and dispense with the mechanical height switch. However, as the condition of variable truck characteristics (i.e., truck components age, battery charge, load level, operating temperature, hydraulic fluid levels . . . ) change over time, the calculated height becomes less accurate.

For example, a series of control signals may require a lift rate of 2 feet per second for 2 seconds. Under ideal conditions, assuming an initial height of zero feet, the calculated height would be 4 feet (i.e. (2 feet/sec.)(2 sec.)). However, assuming the fork carriage is battery powered, where the battery charge is low, the actual height may be less than 4 feet. If the calculated height is not adjusted to compensate for the low battery charge, the system would limit maximum truck speed prior to the fork carriage actually reaching the trip height.

Variable sensors and their data can be used to automatically compensate for some variable truck characteristics. Nevertheless, some variable characteristics, (e.g., age and use demands) cannot be foreseen and are difficult to compensated for during the design process. This means that over time the calculated height may become less accurate.

Just as the calculated height mechanism is used to verify mechanical height switch integrity, so too, the mechanical switch can be used to verify calculated height mechanism integrity. The trip height is easily identifiable by the location of the height switch. Where the calculated height mechanism becomes sufficiently inaccurate due to uncompensated variable truck characteristics, the calculated height mechanism will limit maximum truck speed prior to the actual trip heights (e.g., at 9 feet instead of 10 feet). Where this is the case, maintenance personnel can manually adjust the calculated height mechanism so that its future calculations reflect reality.

Other and further objects and aspects of the present invention will become apparent during the course of the following description and by reference to the accompanying drawings.

DETAILED DESCRIPTION OF THE PREFERRED EMBODIMENT

Figure 1:
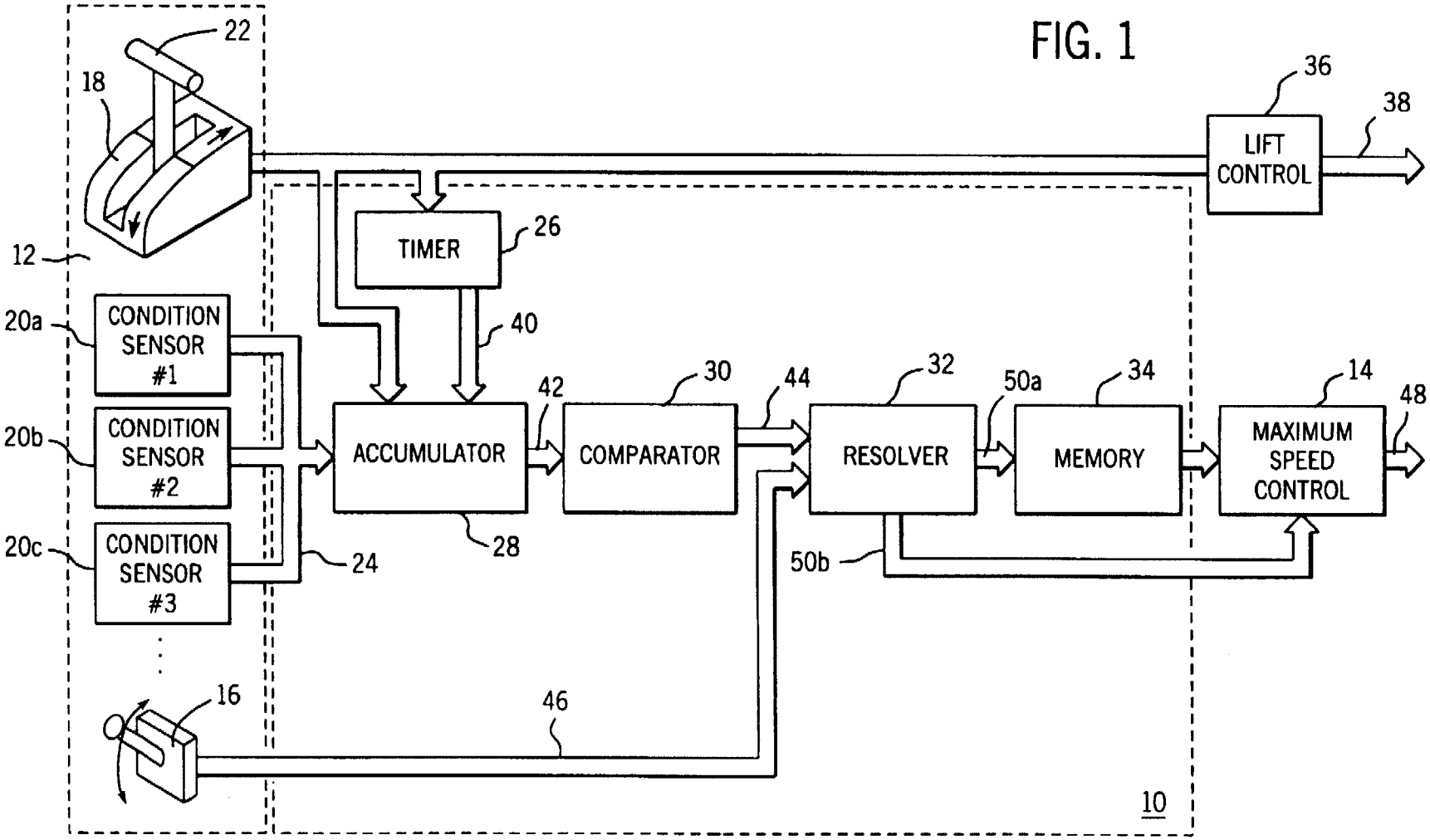
FIG. 1 is a block diagram showing the main components of a control apparatus according to the present invention.

Referring now to FIG. 1, the inventive control mechanism 10 receives input signals from various input devices 12, uses the input signals to determine whether or not a limit switch 16 is malfunctioning and provides signals to a maximum speed control 14 to limit maximum truck speed when either the switch 16 indicates that fork carriage height has exceeded a switch trip height or when the control mechanism 10 determines that the switch 16 has malfunctioned.

Preferably, the limit switch 16 is a two state switch which is either triggered and on, in which state it provides a sensed signal on bus 46, or un-triggered and off, in which state it provides no signal on bus 46. The switch 16 is triggered when a fork carriage (not shown) is at or above the trip height and is untriggered when the fork carriage is below the trip height. Thus, transition from below to above the trip height is indicated when the switch 16 is triggered and a sensed signal is provided and transition from above to below the trip height is indicated when switch 16 condition changes from triggered to untriggered and the sensed signal ceases.

The input devices 12 includes an operator input 18, a plurality of condition sensors **20*a*–20*c* and one or more limit switch(es) 16. The operator input 18 may be any form of input device allowing an operator to signal that the fork carriage should be raised or lowered at various rates. For example, an operator may want to raise a fork carriage at the rate of 3 feet per second or at the rate of 1 foot per second. In the preferred embodiment, the operator input 18 includes a lever 22** having continuously variable positions corresponding to different continuously variable fork carriage rates.

When the lever 22 is moved to raise or lower the fork carriage, a signal indicating direction (i.e. up or down) and required height rate change is provided to a fork carriage control 36. The fork carriage control 36 generates fork carriage signals 38 that drive a lifting motor and associated hydraulic valves to change fork carriage height in a manner that should be well known to a per son of ordinary skill in the lift truck art.

Each condition sensor **20*a*–20*c* is capable of sensing some variable truck characteristic and providing a signal on bus 24 indicating the status of the variable characteristic. For example, one condition sensor 20*a* may monitor battery condition or truck operating temperature while another condition sensor 20b may monitor the weight of a load being lifted by the truck. Given a set of lifting instruction, the actual fork carriage height may vary depending upon variable truck characteristic conditions. The variable characteristics are monitored to provide information to the control mechanism 10 to allow the control mechanism 10 to accurately calculate a fork carriage height despite varying characteristics. How the condition sensor data is used by the control mechanism 10** will be explained in more detail below.

One of the condition-sensors 20a–20c may be equipped to allow maintenance personnel to periodically adjust a variable factor affecting the height calculation. As truck components age, the height calculation may become less accurate. This is particularly true where a truck is subjected to prolonged rigorous operation. Where the calculated height becomes insufficiently accurate, maintenance personnel could adjust the variable factor so that the calculated height again reflects reality in future calculations.

The control mechanism 10 includes a timer 26, accumulator 28, a comparator 30, a resolver 32 and a nonvolatile memory 34.

The timer 26 receives input signals from the fork carriage lever 22 and tracks the time during which the fork carriage lever 18 is in any given position requiring a certain desired rate of height change. The timer 26 provides a current period signal on bus 40 indicating the length of time during which the lever 22 has been in a given position. Each time the lever 22 is moved to modify the rate of height change, the timer begins tracking a new current period and produces the new current period signal on bus 40.

The accumulator 28 receives the current period signal. In addition, the accumulator 28 receives input signals from the fork carriage lever 22 indicating the rate of fork carriage height change and direction during each current period. The accumulator 28 uses the signals received to generate a calculated fork carriage height and provide a calculated signal on bus 42 indicative of the calculated fork carriage height.

Figure 2:
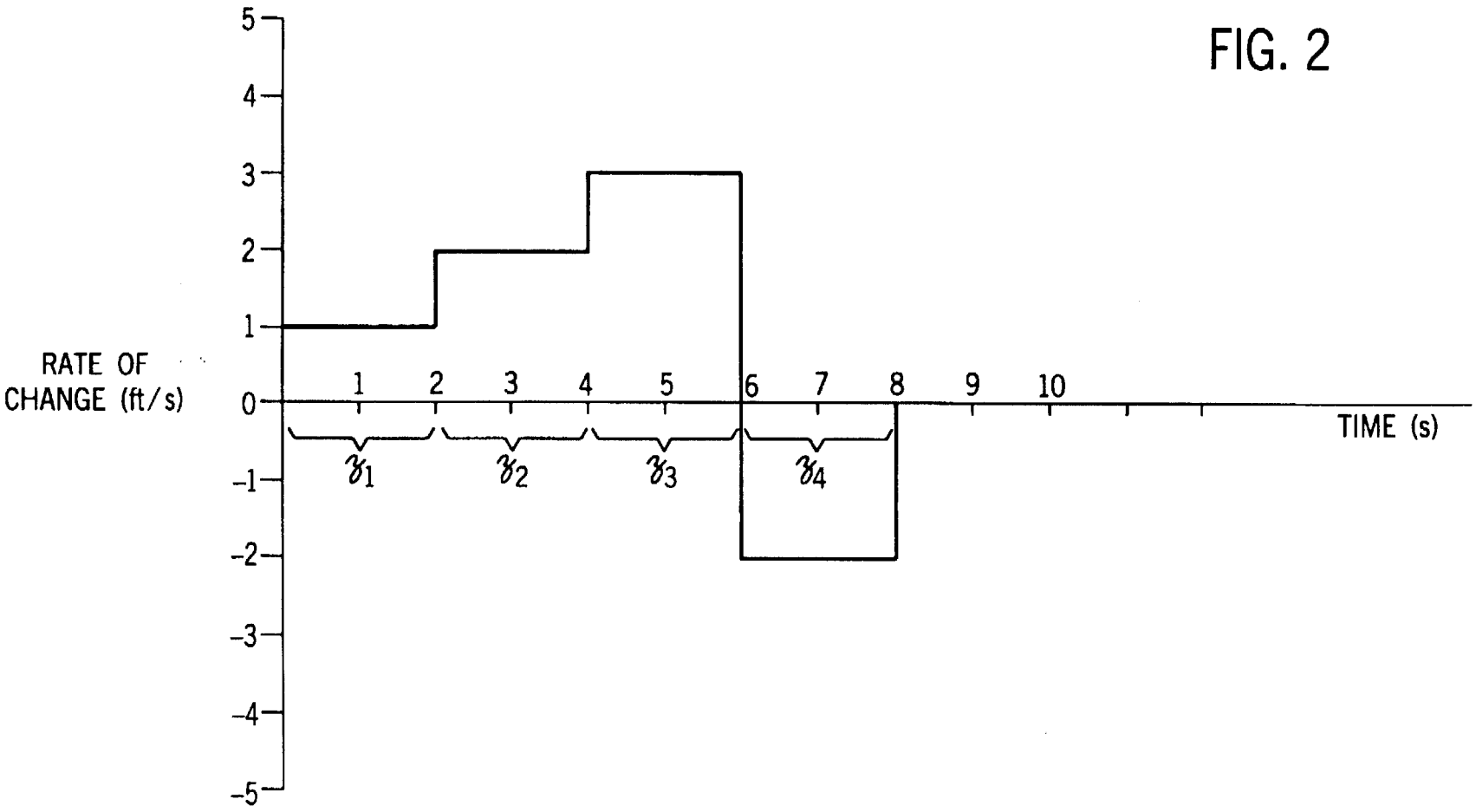
FIG. 2 is a graph illustrating various rates of fork carriage height change.

Ideally, the accumulator 28 could generate the calculated fork carriage height by simply multiplying the period signals on bus 40 by corresponding rates of change required by an operator manipulating the fork carriage lever 22. For example, referring also to FIG. 2, a graph illustrates various periods and rates of fork carriage height change during those periods which could ideally be used to determine fork carriage height. Assuming an initial fork carriage height of zero feet, during a first period $\zeta_1$ between zero and 2 seconds, the rate of fork carriage height change is 1 foot per second. Therefore, at the end of the first period $\zeta_1$ the current fork carriage height would be 2 feet (i.e. 2 seconds times 1 foot per second rate of change). During a second period $\zeta_2$, the rate of fork carriage height change is increase to 2 feet per second and the second period $\zeta_2$ is two seconds long. Therefore, at the end of the second period $\zeta_2$, the fork carriage height would be 6 feet (i.e. the initial 2 foot height at the beginning of the second period $\zeta_2$ plus the increase during $\zeta_2$ which is 2 seconds times 2 feet per second). Similarly, at the end of a third two second period $\zeta_3$ where the rate of change is 3 feet per second, the fork carriage height would be 12 feet. During a fourth 2 second period $\zeta_4$, the rate of change is −2 feet per second. Therefore, at the end of the fourth period $\zeta_4$ the fork carriage height is 8 feet.

In reality, there are other variables that affect fork carriage height such as truck operating temperature, battery condition, load weight, and truck age, to name a few. To account for these other variables, in addition to receiving the rate of change information and the period signal, the accumulator 28 also receives variable characteristic information on bus 24 from the condition sensors 20a–20c. Based on the variable condition information received, the accumulator 28 adjusts the calculated fork carriage height.

The calculated signal is provided to the comparator 30 via bus 42. The comparator 30 includes a memory (not shown) wherein a trip height is stored. The stored trip height is the actual trip height of the limit switch 16 on a fork carriage mast. Therefore, where the limit switch 16 is 8 feet high, the stored sensor height is 8 feet. The comparator 30 compares the calculated height to the stored trip height and, where the calculated height either equals or is greater than the stored trip height, the comparator 30 provides a limit signal on bus 44 indicated that the trip height has been reached.

The resolver 32 receives both the limit signal and a sensed signal. The resolver 32 identifies when a limit signal 44 has been received and no corresponding sensed signal 46 has been received. When a limit signal 44 has been received but no corresponding sensed signal 46 has been received, the switch 16 has failed for some reason.

When a switch fails, the resolver 32 produces a first signal 50a that sets a latch in the non-volatile (i.e., survives turn-off and turn-on) memory 34 which indicates a failed switch. When the latch is set, a signal is provided to the maximum speed control 14 causing the maximum speed control to limit the maximum speed of the truck. The maximum speed control 14 then provides signals via bus 48 to a speed motor controller (not shown) to control truck speed.

When the latch is set indicating that the switch 16 has malfunctioned, the maximum speed control maintains a reduced maximum truck speed even when the fork carriage is lowered below the switch trip height until the switch 16 operates properly in both fork carriage raising and fork carriage lowering operations. In other words, after the switch 16 is found to have malfunctioned, the mechanism 10 will not allow any high speed truck operation until the mechanism 10 determines that the switch 16 is again operating properly.

When the resolver 32 receives both a limit signal 44 and a corresponding sensed signal 46, the resolver 32 produces a second signal 50b causing the speed control 14 to reduce maximum truck speed. When the second signal 50b is produced, the resolver 32 does not set the latch in the memory 34.

When the latch is not set, the truck operates normally. In other words, with the latch not set, when the fork carriage is raised above the trip height, truck speed is reduced and when the fork carriage is lowered below the trip height the maximum truck speed increases to the normal maximum speed.

While the invention has been described above in relation to an apparatus having various components, it should be appreciated that the present invention also includes a method which can be performed by a microprocessor running software wherein the microprocessor includes a timer, memory and circuitry for carrying out calculations.

Figure 3:
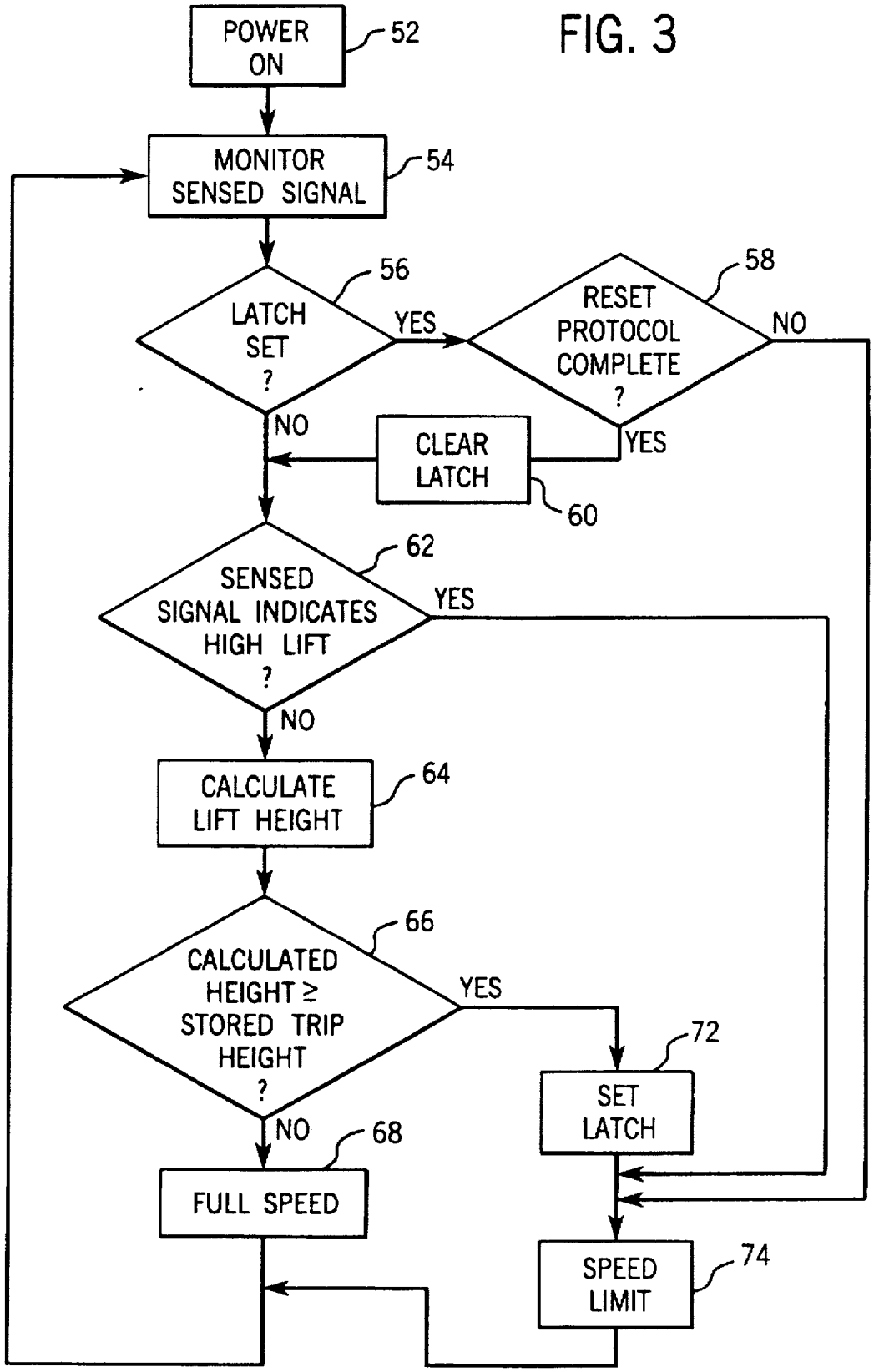
FIG. 3 is a flow chart showing the steps of a preferred method according to the present invention.

Referring now to FIG. 3, a preferred method begins when a truck is turned on at process block 52. When a truck is turned on, the microprocessor monitors the sensed switch signals from switch 16 at process block 54. Next, at decision block 56, the microprocessor determines whether or not a latch has been set indicating that the switch 16 failed to operate properly the last time switch integrity was determined. Because the latch is stored in a nonvolatile memory, the latch survives truck turn-off and subsequent turn-on. If the latch is set indicating switch failure, the latch will remain set and maximum truck speed will be limited until the processor determines that the switch 16 is again operable. The microprocessor identifies switch operability by stepping through a reset protocol represented by decision block 58.

Preferably, the reset protocol 58 includes a plurality of steps responsive to sensed signals monitored at process block 54. The reset protocol identifies a trigger pattern that indicates proper switch operations. The preferred trigger pattern includes a sensed signal pattern first indicating fork carriage movement from below to above the trip height and second, movement from above to below the trip height. Initially, there should be no sensed signal because the fork carriage is below the trip height and therefore, the limit switch would not be triggered. As the fork carriage is lifted and reaches the trip height, a sensed signal should be identified once the switch is triggered. Then, as the fork carriage is subsequently lowered, eventually the fork carriage ascends below the trip height and the sensed signal ceases. In short, a preferred required signal pattern to reset the latch and allow normal maximum truck speed is: (1) no sensed signal, (2) sensed signal, and (3) no sensed signal.

When the required signal pattern is identified at decision block 58, the microprocessor clears the latch at process block 60. If the required signal pattern is not identified at block 58, the microprocessor jumps to process block 74 and continues to limit maximum truck speed.

Referring again to decision block 56, where the latch is not initially set, the microprocessor determines whether or not the sensed signal exists indicating a high fork carriage (i.e., switch 16 has been triggered) at decision block 62. Where the switch is triggered, the microprocessor again jumps to block 74 and limits maximum truck speed. Where the switch is not triggered, the microprocessor calculates fork carriage height at block 64 using information from the condition sensors 20*a*–20*c*, fork carriage lever 18, and timer 26. After determining the calculated fork carriage height, at decision block 66 the microprocessor determines whether or not the calculated fork carriage height is equal to or exceeds the stored trip height.

Where the calculated height is less than the stored trip height, at block 68 the microprocessor indicates that maximum truck speed should be allowed. However, where the calculated fork carriage height is equal to or exceeds the stored trip height, the microprocessor recognizes an error (i.e., switch failure) and sets the latch at block 72 to limit truck speed until the latch is cleared. Microprocessor control then jumps to block 74 and limits maximum truck speed. This process continues repetitively during truck operation so that switch integrity is checked each time the fork carriage reaches the trip height.

While this description has been by way of example of how the present invention can be carried out, those with experience in the art will recognize that various details may be modified to design other detailed embodiments, and that many of these embodiments will come within the scope of the invention. For example, while the invention is described as having a single height sensing switch, the present invention would clearly cover a system wherein two or more height sensing switches are included and the control mechanism 10 could monitor operation of all or a subset of the switches. In addition, while the present invention is described as being used with a limit switch, clearly, the present invention contemplates any type of height sensing mechanism including proximity sensors of all types, direct measuring devices, ranging equipment using sonar or other technology, incremental encoders, position sensing potentiometers, and the like.

Moreover, while the accumulator 28 preferably takes into account variable truck characteristics such as temperature, hydraulic liquid level and battery condition, this may not be necessary. For example, the variable truck characteristics may only affect a calculated fork carriage height by a small degree (i.e. 2%). Instead of accounting for these characteristics automatically, the stored trip height used by the comparator 30 could simply be increased by 2% so that, the limit signal 44 would not be provided until the calculated fork carriage height exceeds the trip height by 2%. In the alternative, one of the variable sensors 20*a*–20*c* could be used to adjust the calculated height value on a daily, weekly, or monthly basis so that they reflect reality.

In addition, the latch clearing protocol could be different than described above. Furthermore, it should be realized that, while the preferred embodiment includes a non-volatile memory latch, the present invention could be equipped with a volatile memory latch that, after system logic has been turned off and turned back on, clears the latch and allows normal operation until another switch failure is detected.

Moreover, while the present invention is described as one wherein a calculated fork carriage height is determined by the position of a lever and the periods during which the lever is in each position along with other characteristic truck variables, the calculated fork carriage height could be calculated by other means. For example, the calculated height could be tied to hydraulic fluid pressure or fluid movement or lifting motor cycles. In these cases instead of using control signals to determine fork carriage height, sensed signals could be used.

Therefore, to apprise the public of the scope of the invention and the embodiments covered by the invention the following claims are made.

We claim:

1. An apparatus for use with a lift truck control system, the truck including a substantially upright mast and a carriage connected to and moveable along the mast, the truck also including a sensor positioned at a trip height on the mast to sense and provide a sensed signal when the carriage has exceeded the trip height, the system providing system signals from which carriage height can be estimated, the system for altering truck operation when carriage height exceeds the trip height, the apparatus comprising:

an accumulator responsive to the system signals for determining a calculated carriage height;

a comparator providing a limit signal when the calculated carriage height exceeds a limit height where the limit height is at least as high as the trip height; and a resolver responsive to both the limit signal and the sensed signal, the resolver altering truck operation when the limit signal is received and the sensed signal is not received.

2. The apparatus of claim 1 wherein the system signals are control signals for controlling truck operation carriage height and the accumulator is responsive to the control signals.

3. The apparatus of claim 2 wherein one alterable truck characteristic is truck speed and the resolver alters truck operation by limiting a maximum truck speed.

4. The apparatus of claim 3 wherein the limit height is the trip height.

5. The apparatus of claim 3 wherein the trip height includes at least two different trip heights, the sensor includes one sensor for each trip height that provides a unique sensed signal when an associated trip height is reached, and the system is to limit truck speed as a function of the unique sensed signals, and wherein the comparator provides a unique limit signal for each trip height when the calculated height exceeds an associated trip height and the resolver limits maximum truck speed when a limit signal is received and a corresponding sensed signal is not received.

6. The apparatus of claim 3 further including a timer for determining the lift time during which carriage height signals are provided, the control signals used to determine the carriage height including carriage height signals, the accumulator using the carriage height signals and the lift time to determine the calculated height.

7. The apparatus of claim 3 further including a non-volatile memory wherein, when a limit signal is received, if a sensed signal is not received, the resolver reduces the maximum truck speed and sets the memory so as to limit truck speed until the resolver receives both a sensed signal and a limit signal thereby indicating that the sensor is operative.

8. The apparatus of claim 3 wherein the lift truck also includes means for monitoring lift truck variables that may effect truck operation and, in addition to being responsive to control signals when determining the calculated height, the accumulator is also responsive to the monitored variables.

9. The apparatus of claim 8 wherein the monitored variables include battery condition, load weight, operating temperature, and truck age.

10. A method for use with a lift truck control system, the truck including a substantially upright mast and a carriage connected to and moveable along the mast, the truck also including a sensor positioned at a trip height on the mast to sense and provide a sensed signal when the carriage has exceeded the trip height, the system providing system signals from which carriage height can be estimated, the system signals including control signals for controlling truck operation including carriage height, the system for altering truck operation when carriage height exceeds the trip height, the method comprising the steps of:

monitoring the control signals;

determining a calculated carriage height using the monitored control signals;

providing a limit signal when the calculated carriage height exceeds a limit height where the limit height is at least as high as the trip height; and altering truck operation when the limit signal is provided and the sensed signal is not provided.

11. The method of claim 10 wherein one alterable truck characteristic is truck speed and the step of altering truck operation includes the step of limiting a maximum truck speed.

12. The method of claim 11 wherein the limit height is the trip height.

13. The method of claim 11 wherein the trip height includes at least two different trip heights, the sensor includes one sensor for each trip height that provides a unique sensed signal when an associated trip height is reached, and the system is to limit truck speed as a function of the unique sensed signals, and wherein the step of providing a limit signal includes the step of providing a unique limit signal for each of the trip heights when the calculated height exceeds the trip height and the step of limiting maximum speed includes the step of limiting maximum speed any time a limit signal is provided and a corresponding sensed signal is not provided.

14. The method of claim 10 wherein the system also includes a timer for determining the lift time during which carriage command signals are provided and the control signals used to determine the calculated height include carriage height signals, the step of determining the calculated carriage height including the step of mathematically combining the carriage height signals and the lift time.

15. The method of claim 11 wherein the system also includes a non-volatile memory wherein, when a limit signal is provided, if a sensed signal is not provided, the step of limiting the maximum speed includes the step of setting the memory so as to limit truck speed until the system is reset.

16. The method of claim 15 further including the step of, after setting the memory to limit truck speed, monitoring the calculated and sensed signals to determine if the system has been reset, the system being reset when both sensed and associated limit signals are provided, and, after the system has been reset, allowing normal truck operation until a limit signal is sensed and an associated sensed signal is not sensed.

17. The method of claim 11 wherein the truck also includes means for monitoring truck variables that may effect truck operation and wherein the step of determining includes the step of compensating for the condition of the monitored variables.

18. An apparatus for use with a lift truck control system, the truck including a substantially upright mast and a carriage connected to and moveable along the mast, the truck also including a sensor positioned at a trip height on the mast to sense and provide a sensed signal when the carriage exceeds the trip predetermined height, the system providing control signals to control truck operation including a carriage height signal to control carriage height, the system for altering truck operation when the carriage exceeds the trip height, the apparatus comprising:

a timer for determining the lift time during which carriage height signals are provided;

an accumulator responsive to the carriage height signals for determining a calculated carriage height by mathematically combining the carriage height signals and the lift time;

a comparator providing a limit signal when the calculated height exceeds the trip height;

a non-volatile memory including a latch;

a resolver responsive to both the limit signal and the sensed signal, the resolver setting the memory latch when a limit signal is received and an associated sensed signal is not received; and wherein, a maximum truck speed is limited when the latch is set.

19. The apparatus of claim 18 wherein the lift truck also includes means for monitoring lift truck variables that may effect truck operation and, in addition to being responsive to control signals when determining the calculated height, the accumulator is also responsive to the monitored variables.

20. A method for use with a lift truck control system, the truck including a substantially upright mast and a carriage connected to and moveable along the mast, the truck also including a sensor positioned at a trip height on the mast to sense and provide a sensed signal when the carriage has exceeded the trip height, the system providing system signals from which carriage height can be estimated, the system for altering truck operation when carriage height exceeds the trip height, the method comprising the steps of:

monitoring the system signals;

determining a calculated carriage height using the monitored system signals;

providing a limit signal when the calculated carriage height exceeds a limit height where the limit height is at least as high as the trip height; and altering truck operation when the limit signal is provided and the sensed signal is not provided.

* * * * *